US006678901B1

(12) United States Patent
La Rossa

(10) Patent No.: US 6,678,901 B1
(45) Date of Patent: Jan. 20, 2004

(54) UV PROTECTED HANDRAIL SLEEVE

(76) Inventor: Michael J. La Rossa, 4233 Birnam Ter., North Port, FL (US) 34286

( * ) Notice: Subject to any disclaimer, the term of this patent is extended or adjusted under 35 U.S.C. 154(b) by 0 days.

(21) Appl. No.: 10/340,114

(22) Filed: Jan. 10, 2003

(51) Int. Cl.[7] ..... E04H 4/14
(52) U.S. Cl. ..... 4/496; 150/154
(58) Field of Search ..... 4/496; 182/106; 256/59; 150/154

(56) References Cited

U.S. PATENT DOCUMENTS 4,985,942 A 1/1991 Shaw
5,936,037 A * 8/1999 Tasaka ..... 525/92 B
6,523,584 B1 * 2/2003 Rehrig ..... 150/154
6,601,245 B2 * 8/2003 Weiss ..... 4/496

* cited by examiner

*Primary Examiner*—Robert M. Petsuga
(74) *Attorney, Agent, or Firm*—Frank A. Lukasik

(57) ABSTRACT

A combination of a handrail cover and a handrail consisting of a strip of heavy duty polyester based fabric, blended and dyed to resist fading and impregnated with UV protecting liquids, a strip of closed cell neoprene foam layer having two adhesive surfaces is laminated to the fabric, a zipper is attached to opposite ends of the fabric, the cover is wrapped around the handrail, and zipped closed. The inner elastic surface prevents the cover from sliding on the handrail. A tie wrap further secures the cover while covering the zipper in the locked position.

3 Claims, 2 Drawing Sheets

UV PROTECTED HANDRAIL SLEEVE

BACKGROUND OF THE INVENTION

This invention relates to a protective sleeve for a handrail used in connection with a swimming pool or spa, and, more particularly, to a handrail sleeve that is disposed around and along the handrail and which is composed of non absorbent UV protected material laminates.

Swimming pool or spa handrails generally are made of tubular metal, often chrome-plated or otherwise of a high shine or glass metallic surface. Handrails each have in common a single length of tubing embedded of otherwise affixed to concrete or stone surrounds of the pool or spa. They are generally placed in close proximity to the pool steps or pool lip to facilitate ease of entry or exit therefrom. Swimmers' wet hands keep the rails or any covering thereupon, wet throughout the day—or night. This wetness, in combination with constant exposure to the sun, causes rapid deterioration of any sleeve or covering applied to the handrail.

Prior art such as those disclosed in U.S. Pat. No. 4,985,942 issued to Shaw on Jan. 22$^{nd}$ 1991 are constructed from a lamination of materials including neoprene and various synthetic rubbers and which is variously attached in place with zippered, buttoned or laced closures. The present invention is an improvement on the prior art through the use of materials which are UV protected and which provides a secure attachment means and which permit the sleeve to be cleaned in place for lower maintenance.

SUMMARY OF THE INVENTION

The present invention comprises a removable sleeve for being secured around the exterior surface of a tubular metal handrail. Using a five step manufacturing process, the sleeve becomes a laminated construction comprising; a ⅛" foam skin, a heavy duty polyester based fabric blended and dyes to resist fading, UV/Ozone rays, algae and chlorinated water. A durable outdoor nylon zipper is sewn into the cover for ease of installation. An inner skin incorporates an adhesive strip for non-twisting and the entire unit is secured in place with a nylon tie lock. The invention sleeve is designed to remain in place where it can be cleaned using a suitable cleaning solution to remove calcium or other deposits resulting from exposure to chlorine.

A primary object of the invention is to provide handrail sleeve for, but not limited to, handicap rails, marine handrails, bar handrails, bathroom handrails, outdoor handrails and swimming pool and spa handrails, and which can be easily installed using a zipper fastener and which can be secured in place with a plastic tie fastener.

It is a further object of the invention to provide a sleeve which can be colored either Royal Blue, Aqua Teal or Taupe Beige. These colors being chosen for their durability in outdoor use.

It is a further object of the invention to provide an adhesive inner surface to prevent the sleeve from slipping during use.

It is a further object of the invention to provide a durable woven cover which has been protected from UV deterioration through the application of UV protective sprays during the process of weaving at the mill or subsequent to the lamination of the layers of the sleeve.

These as well as other advantages of the invention together with modifications of the components thereof within the purview of the invention and further disclosed in the illustrations annexed hereto, will be evident to those skilled in the art.

DETAILED DESCRIPTION OF THE INVENTION

The manufacturing process involves three steps:

1. FABRIC TREATING

The fabric treating process allows the application of a UV inhibitor spray to the woven fibers of the cloth at the weaving mill, or alternatively, the spray may be topically applied to the woven cover. The latter process does not however provide the protection of the former because the spray is not as well absorbed into the fibers. The fabric treating process involves weaving a 100% undyed 9 oz Polyester thread to precise specifications for fade resistance, Color, UV resistance, chemical resistance and complete elongation. Such specifications include the use of 100% Polyester Swiss Pique Fabric woven in 55" to 60" cuttable. Fabric is approximately 9.10 (+−) 0.25 ounces per linear yard in single rolls of approximately 80 to 120 yards. Wide elongation is approximately 50% and length elongation approx. 25%. Fabric is processed with highest lightfast automotive grade dyes and with a UV inhibitor to achieve superior performance against lightfast testing to 300 hours. Dimensional change is approximately −0.16% DC in width and −0.83 DC in length. Color measurement is 1.25 or less DECMC against standard. Flame retardation passes MVSS 302 and CAL. 117. The fabric has slight abrasive resistance and may be laminated to neoprene, foam, urethane or any other laminates.

2. LAMINATION

The lamination process laminates the fabric to a closed cell neoprene foam by means of a Web Adhesive or Double sided tape adhesive and bonded by thermo adhesion or other heat process at a temperature between 150 and 190 degrees to ensure a complete bond which will not separate. The bonding materials used allow the fabric and neoprene to stretch evenly in length and width. A UV inhibitor is included to protect the bond against chlorinated chemicals, UV rays and direct sunlight.

3. SLITTING

The woven and bonded fabric rolls (60" in width) are slit into various widths ranging between 3" and 5¾" to fit handrails of different diameters. The slit fabric rolls are finally finished by cutting length and by the attachment of zipper, hook and loop fasteners or other fastening means and the by the rolling and finishing of the cut edges.

Figure 1:
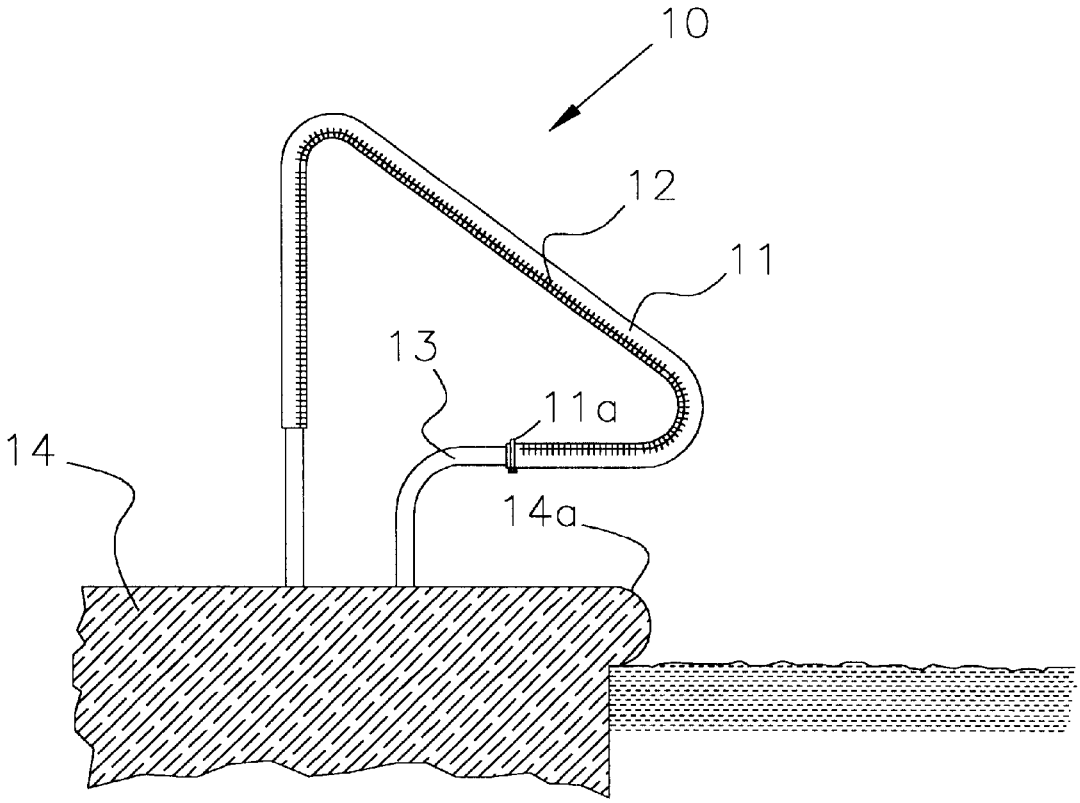
FIG. 1 is a side view of the invention installed in a swimming pool or spa handrail.
Figure 2:
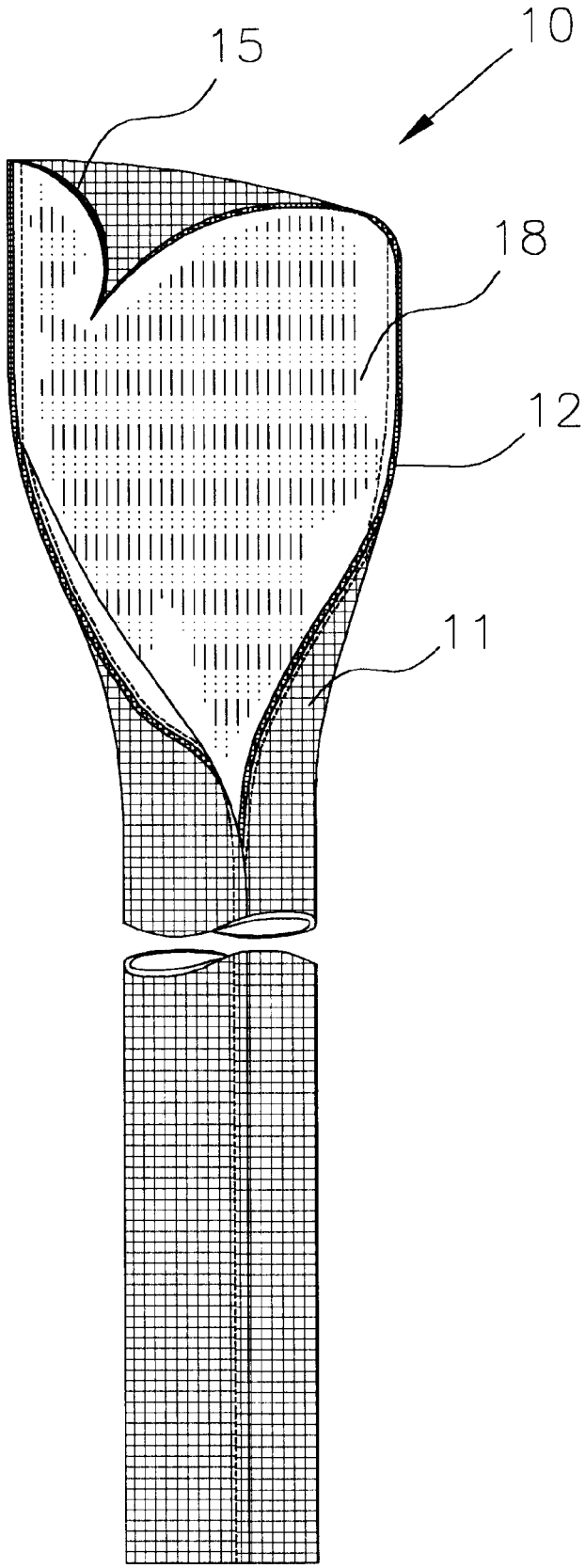
FIG. 2 is an elevation view partially in section of a preferred embodiment of the invention.

Referring now to the drawings in which like numerals designate like and corresponding parts throughout the several views in FIG. 1 and FIG. 2 the invention is designated overall by the numeral 10. In FIG. 1 there is shown a commonly used handrail 13 which is normally made of a highly polished metallic tubular material. Such a handrail comprises a single length of tube having both ends secured in a deck 14 so that there are no exposed or accessible handrail ends. The handrail is positioned in close proximity to pool edge 14*a* so that it may be readily and conveniently grasped by a user from within the pool.

As shown in FIG. 1, protective sleeve 11 may be readily placed over handrail 13 and fastened with zipper 12 thereupon and secured in place with plastic tie 11*a*.

Referring now to FIG. 2, the invention is designated overall by the numeral 10. Outer woven layer 11 being substantially or generally a rectangular sheet having a zipper 12 is laminated to an inner foam layer 18 which is in turn, laminated to an inner adhesive layer 15.

UV protected woven fabric layer 11 is exposed outwardly when sleeve 10 is closed and zippered and thereby protects inner foam layer 18 and adhesive layer 15.

A tie wrap 11*a* is wrapped around the lower end of cover 10 after the zipper 12 is completely closed. The tongue of the zipper 12 is in the locked position and completely covered by the tie wrap 11*a*. The tie wrap 11*a* is secured tightly and the excess length is trimmed.

ASSEMBLY

The first step is to clean and dry the handrail 13 thereby removing any moisture or oils. Starting 6" above the water line, begin wrapping the unprinted end of the wrap 10 around the handrail. The inner foam layer 18 must remain dry to adhere to the handrail 13. The first six inches of the zipper 12 of cover 10 are then closed with the zipper 12 on the underside. With the cover now secured at the water end, the remainder is then stretched slightly and zipped up completely and evenly. The tie wrap 11*a* is then secured tightly and the excess length is trimmed.

In a second embodiment, rather than applying the UV inhibitor at the time of manufacture, the UV inhibitor is applied, as by spraying, after the cover 10 is assembled.

What is claimed is:

1. A combination of a handrail cover and a handrail for a pool, SPA, and other handrails, said cover comprising:

a strip of heavy duty polyester based fabric, blended and dyed to resist fading, said fabric being impregnated with UV protecting liquids, said fabric having a first side, a second side, a first edge and a second edge, a strip of closed cell neoprene foam layer having a first side and a second side, said first side having a first adhesive surface, and said second side having a second adhesive surface, said first adhesive surface being laminated to said second side of said fabric with said adhesive surface by a heat process, said adhesive being impregnated with UV protecting liquids, said cover being placed over said handrail and being adhered to said handrail by said second adhesive surface, said cover being wrapped around said handrail, a zipper attached to said fabric first edge and said second edge for connecting said edges together and thereby forming a tube shaped cover for a variety of applications, and a tie wrap placed around a lower end of said cover for securing said cover tightly to said handrail.

2. The combination of a handrail cover and a handrail of claim 1 wherein said polyester based fabric consists of a 100% polyester Swiss Pique fabric, 9.10 (+–) 0.25 ounces per linear yard, processed with lightfast automotive grade dyes with a UV inhibitor.

3. The combination of a handrail cover and a handrail of claim 1 wherein said polyester based fabric is impregnated with a UV inhibitor by spraying the inhibitor onto the surface of said first side.

* * * * *